US011346504B2

(12) United States Patent
Madison

(10) Patent No.: US 11,346,504 B2
(45) Date of Patent: May 31, 2022

(54) CRYOGENIC CONTAINER WITH RESERVE PRESSURE BUILDING CHAMBER

(71) Applicant: Chart Inc., Ball Ground, GA (US)

(72) Inventor: Grant Madison, Owatonna, MN (US)

(73) Assignee: Chart Inc., Ball Ground, GA (US)

( * ) Notice: Subject to any disclaimer, the term of this patent is extended or adjusted under 35 U.S.C. 154(b) by 39 days.

(21) Appl. No.: 15/873,182

(22) Filed: Jan. 17, 2018

(65) Prior Publication Data

US 2018/0202609 A1 Jul. 19, 2018

Related U.S. Application Data

(60) Provisional application No. 62/447,185, filed on Jan. 17, 2017.

(51) Int. Cl.

| | |
|---|---|
| ***F17C 13/04*** | (2006.01) |
| ***F17C 9/00*** | (2006.01) |
| ***F17C 7/02*** | (2006.01) |

(52) U.S. Cl.

CPC ..... *F17C 9/00* (2013.01); *F17C 7/02* (2013.01); *F17C 13/04* (2013.01);

(Continued)

(58) Field of Classification Search

CPC ..... F17C 13/04; F17C 2201/0109; F17C 2201/0166; F17C 2201/0171;

(Continued)

(56) References Cited

U.S. PATENT DOCUMENTS

| | | | | |
|---|---|---|---|---|
| 2,729,068 | A | 1/1956 | Mitchell | |
| 9,903,534 | B2 * | 2/2018 | Gustafson | F17C 7/02 |

(Continued)

FOREIGN PATENT DOCUMENTS

| | | | |
|---|---|---|---|
| DE | 102004043080 | A1 | 3/2006 |
| FR | 3006742 | A1 | 12/2014 |

OTHER PUBLICATIONS

U.S. Appl. No. 67,341,112, filed May 11, 2004, Worm, Steven L.; et al.

(Continued)

*Primary Examiner* — Brian M King

(74) *Attorney, Agent, or Firm* — Cook Alex Ltd.

(57) ABSTRACT

A system for dispensing cryogenic liquid includes a container defining an interior with a partition dividing the interior into primary and reserve chambers. Cryogenic liquid within the primary chamber is separated from cryogenic liquid in the reserve chamber. The partition provides a headspace cornrnurrrcation passage. A primary pressure building circuit has an inlet selectively in liquid communication with the primary chamber and an outlet in fluid communication with the headspaces of the primary and reserve chambers. A reserve pressure building circuit has an inlet selectively in liquid communication with the reserve chamber and an outlet in fluid communication with the headspaces of the primary and reserve chambers. An equalizing circuit is selectively in liquid communication with the primary and reserve chambers. A dispensing line is selectively in liquid communication with the primary chamber.

14 Claims, 3 Drawing Sheets

(52) U.S. Cl.
CPC ..... *F17C 2201/0109* (2013.01); *F17C 2201/0166* (2013.01); *F17C 2201/0171* (2013.01); *F17C 2201/035* (2013.01); *F17C 2203/0391* (2013.01); *F17C 2203/0629* (2013.01); *F17C 2221/033* (2013.01); *F17C 2223/0161* (2013.01); *F17C 2223/033* (2013.01); *F17C 2223/046* (2013.01); *F17C 2227/0107* (2013.01); *F17C 2227/0302* (2013.01); *F17C 2227/0393* (2013.01); *F17C 2250/03* (2013.01); *F17C 2250/043* (2013.01); *F17C 2250/0636* (2013.01); *F17C 2260/02* (2013.01); *F17C 2270/0139* (2013.01)

(58) Field of Classification Search
CPC ..... F17C 2201/035; F17C 2203/0391; F17C 2203/0629; F17C 2221/033; F17C 2223/0161; F17C 2223/033; F17C 2223/046; F17C 2227/01; F17C 2227/03; F17C 2227/0393; F17C 2250/03; F17C 2250/043; F17C 2260/02; F17C 2270/0139
See application file for complete search history.

(56) References Cited

U.S. PATENT DOCUMENTS

| | | | | |
|---|---|---|---|---|
| 2002/0045347 | A1* | 4/2002 | Worm | D06F 43/00 438/689 |
| 2015/0033765 | A1* | 2/2015 | Blalock | F17C 5/04 62/6 |
| 2018/0313496 | A1* | 11/2018 | Garner | F17C 7/04 |

OTHER PUBLICATIONS

The extended European Search Report, dated Jun. 15, 2018, for Application No. 18151976.0.

* cited by examiner

CRYOGENIC CONTAINER WITH RESERVE PRESSURE BUILDING CHAMBER

CLAIM OF PRIORITY

This application claims the benefit of U.S. Provisional Application No. 62/447,185, filed Jan. 17, 2017, the contents of which are hereby incorporated by reference.

FIELD OF THE INVENTION

The present disclosure relates generally to cryogenic containers and, in particular, to a cryogenic container with a reserve pressure building chamber for dispensing residual amounts of liquid cryogen from the container.

BACKGROUND

Cryogenic fluids, that is, fluids having a boiling point generally below −150° C. at atmospheric pressure, are used in a variety of applications, such as mobile and industrial applications. Cryogenic fluids are typically stored as liquids to reduce volume and thus permit containers of more practical and economical design to be used. The liquids are often stored in double-walled bulk tanks or containers with a vacuum between the walls of inner and outer vessels as insulation to reduce heat transfer from the ambient environment into the cryogenic liquid.

During dispensing, the tank is typically pressurized so that the cryogenic liquid is driven from the tank. Tank pressure is often increased using a pressure building circuit that is common on many stationary cryogenic cylinders. These circuits function by using vapor and liquid head pressure to feed liquid cryogen into a pressure building coil or other type of vaporizer. Upon vaporization of the liquid, its volume expands and the resulting gas is routed to the vapor space above the liquid cryogen, building a head of vapor pressure above the liquid phase in the tank.

Most mobile cryogenic liquid containers are mounted horizontally, that is, the longitudinal axis of the tank is generally horizontal or parallel to the surface of the ground. This permits the containers to be transported in ISO specification shipping containers and provides a space efficient profile for vehicle fuel tanks (such as for liquid natural gas powered vehicles). In addition, the horizontal orientation permits the containers to pass through tunnels and under bridges, power lines and the like when transported by a vehicle.

Horizontal cryogenic storage vessels, however, do not maintain a differential pressure sufficient to drive liquid through the pressure building coil at low liquid levels, such as when the tank is nearly empty. More specifically, with reference to FIG. 1*a*, a horizontal tank 10 contains a supply of cryogenic liquid 12 with a vapor headspace 14 above it. A cryogenic liquid dispensing line 16 is connected to the bottom of the tank and features a dispensing valve 18. The distal end of the dispensing line 16 is provided with a nozzle or connector 22 that connects to a use or storage device. A vent line 24 features a vent valve 26 and is in fluid communication with the headspace 14 via spraybar 28. A pressure building line 32 is provided with a pressure building valve 34 and a pressure building coil 36. The outlet of the pressure building coil is provided with a check valve 38 and also communicates with the headspace via spraybar 28.

In operation, the tank 10 is filled to maximum capacity with cryogenic liquid 12, as illustrated in FIG. 1*a*. To dispense the liquid, the connector 22 is connected to a use or storage device. The vent valve 26 may be opened to equalize the pressure between a tank of the use or storage device and the tank 10, and is then closed.

The pressure building valve 34 is then opened. Due to the pressure at the bottom of the tank, which results from the vapor pressure in the headspace 14 in combination with the liquid head of the tank, liquid cryogen travels through line 32 to pressure building coil 36 where it is vaporized. The resulting vapor travels through the check valve 38 and into the headspace 14 through the spraybar 28 so that the tank is pressurized.

When the tank reaches the desired pressure, the dispensing valve 18 is opened and liquid cryogen travels through line 16, connector 22 and into the use or storage device.

As illustrated in FIG. 1*b*, the liquid level of the tank will drop due to the withdrawal of liquid from the tank. This causes an increase in the volume of the headspace 14 and a decrease in the liquid head provided by the cryogenic liquid 12. As a result, there is insufficient pressure at the bottom of the tank to drive the remaining amount of liquid to the pressure building coil 36, and sufficient pressure building within the tank for dispensing can no longer be accomplished. The liquid heel, that is, the residual liquid in the tank, therefore cannot be dispensed through line 16.

The above issue is problematic for a couple of reasons. First, the liquid cryogen remaining in the tank is wasted. Second, over time, the liquid cryogen remaining in the tank will vaporize and increase the tank internal pressure. If a long time passes during storage or transport, such as when the tank is shipped back to the source overseas for refilling, the tank may need to be vented during transport. This is undesirable, especially when a large number of tanks need to be vented.

SUMMARY

Figure 1A:
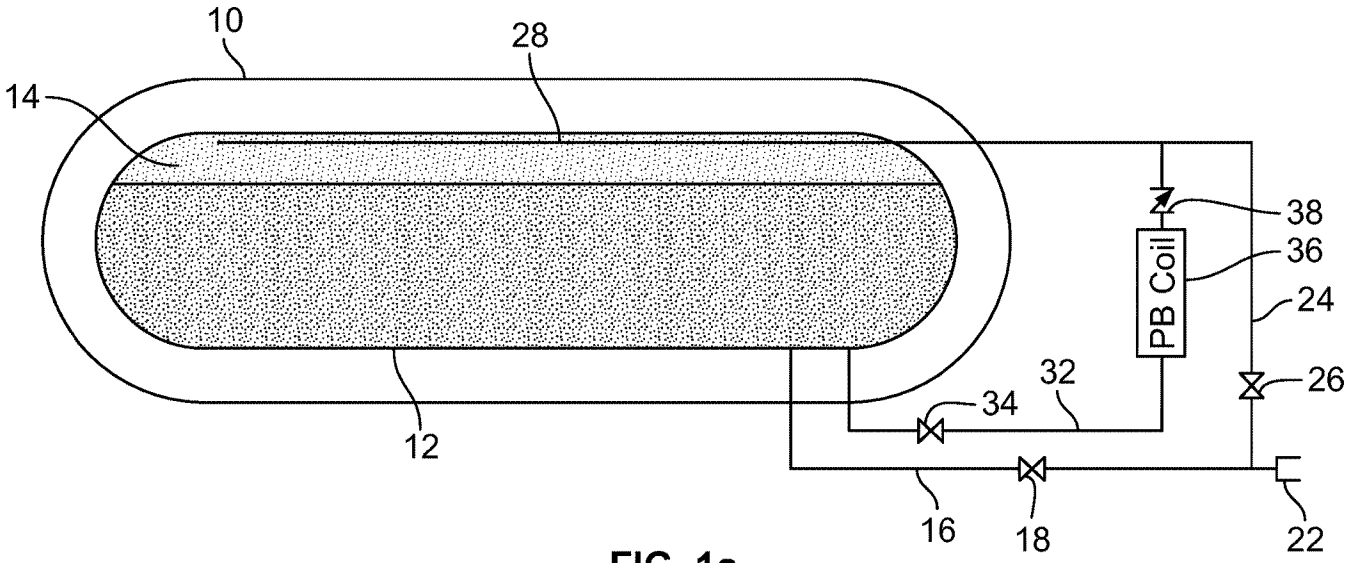
FIG. 1a (Prior Art)
FIG. 1*a* is a schematic view of a prior art cryogenic liquid tank filled with liquid cryogen.
Figure 1B:
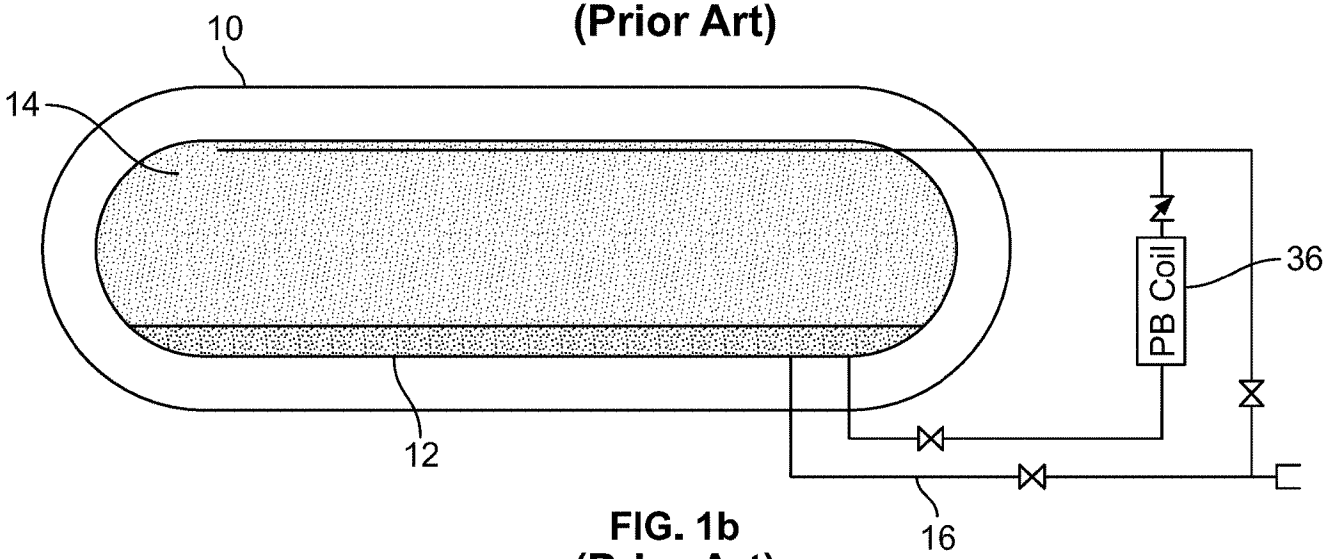
FIG. 1b (Prior Art)
FIG. 1*b* is a schematic view of the tank of FIG. 1*a* after dispensing.

There are several aspects of the present subject matter which may be embodied separately or together in the devices and systems described and claimed below. These aspects may be employed alone or in combination with other aspects of the subject matter described herein, and the description of these aspects together is not intended to preclude the use of these aspects separately or the claiming of such aspects separately or in different combinations as set forth in the claims appended hereto.

In one aspect, a system for dispensing cryogenic liquid includes a container defining an interior. A partition divides the interior into a primary chamber and a reserve chamber, with each of the primary and reserve chambers configured to contain a cryogenic liquid with a headspace above the cryogenic liquid. The cryogenic liquid within the primary chamber is separated from the cryogenic liquid in the reserve chamber. The partition is also configured to provide a headspace communication passage so that the headspace of the primary chamber is in fluid communication with the headspace of the reserve chamber. A primary pressure building circuit has an inlet selectively in liquid communication with a bottom portion of the primary chamber and an outlet in fluid communication with the headspaces of the primary and reserve chambers of the tank. A reserve pressure building circuit has an inlet selectively in liquid communication with a bottom portion of the reserve chamber and an outlet in fluid communication with the headspaces of the primary and reserve chambers of the tank. An equalizing circuit is selectively in liquid communication with the primary and reserve chambers. A dispensing line is selectively in liquid communication with the bottom of the primary chamber.

In another aspect, a container for dispensing cryogenic liquid includes a vessel defining an interior with a partition dividing the interior into a primary chamber and a reserve chamber. Each of the primary and reserve chambers is configured to contain a cryogenic liquid with a headspace above the cryogenic liquid, where the cryogenic liquid within the primary chamber is separated from the cryogenic liquid in the reserve chamber. The partition is also configured to provide a headspace communication passage so that the headspace of the primary chamber is in fluid communication with the headspace of the reserve chamber. A primary cryogenic liquid passage and a liquid dispensing outlet are positioned in a bottom portion of the primary chamber. A reserve cryogenic liquid passage is positioned in a bottom portion of the reserve chamber.

In yet another aspect, a method of dispensing a cryogenic liquid includes the steps of separately storing the cryogenic liquid within a primary chamber and a reserve chamber of a container, where the cryogenic liquid stored in the primary and reserve chambers share a common headspace, vaporizing cryogenic liquid from the primary chamber and using a resulting gas to pressurize the common headspace, dispensing cryogenic liquid from the primary chamber and vaporizing cryogenic liquid from the reserve chamber and using a resulting gas to pressurize the common headspace.

DETAILED DESCRIPTION OF EMBODIMENTS

While the invention is described below in terms of a tank containing cryogenic liquid, it may be used for pressurizing other types of containers and vessels.

Figure 2A:
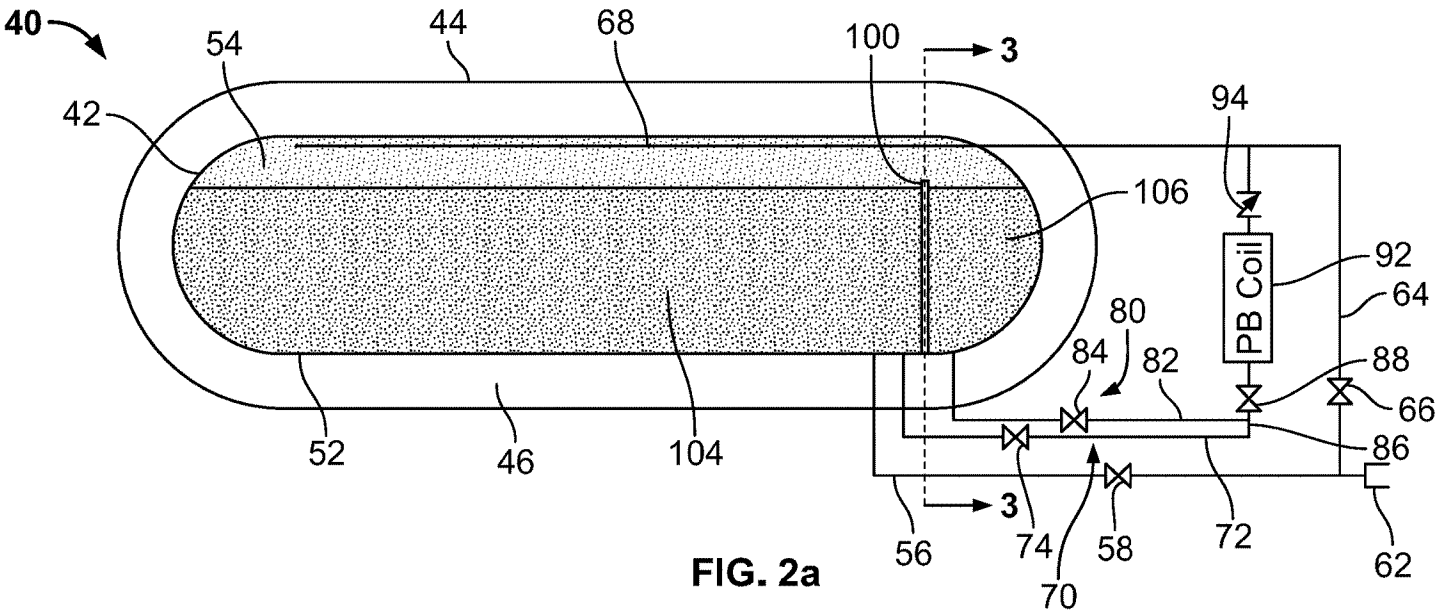
FIG. 2*a* is a schematic view of an embodiment of the container of the invention filled with cryogenic liquid.
Figure 2B:
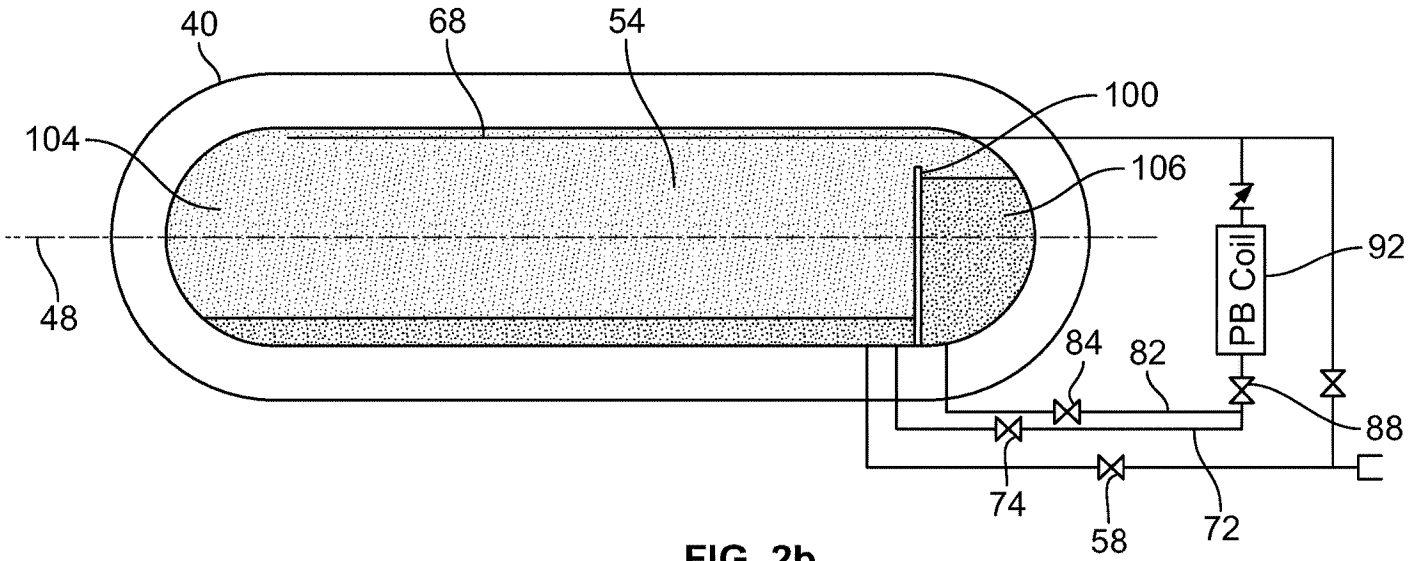
FIG. 2*b* is a schematic view of the container of FIG. 2*a* with the primary compartment of the tank nearly empty of liquid and the reserve compartment still full of liquid.

An embodiment of a tank constructed in accordance with the invention is indicated in general at 40 in FIG. 2*a*. The tank includes an inner vessel 42 surrounded by an outer vessel or jacket 44 with a space 46 therebetween that may be vacuum insulated. Each of the inner and outer vessels feature a cylindrical cross section and are provided with dome shaped end caps. Alternative container shapes may be used. In addition, the container may instead be single-walled or include additional jackets. As illustrated in FIG. 2*b*, the longitudinal axis of the tank, indicated at 48, is generally horizontal or parallel to the ground or other supporting surface. As a result, the tank 40 is a horizontal tank.

The tank contains a supply of cryogenic liquid 52 with a vapor headspace 54 above it.

A cryogenic liquid dispensing line 56 is connected to the bottom of the tank via a liquid dispensing outlet and features a dispensing valve 58. The distal end of the dispensing line 56 is provided with a nozzle or connector 62 that connects to a use or storage device. A vent line 64 features a vent valve 66 and is in fluid communication with the tank headspace 54 via a spraybar 68.

A primary pressure building circuit, indicated in general at 70, includes primary pressure building line 72 and a primary pressure building valve 74. A reserve pressure building circuit, indicated in general at 80, includes a reserve pressure building line 82 provided with a reserve pressure building valve 84. As will be described in greater detail below, both of these pressure building lines extend between the bottom of the tank 40 and a junction 86. An equalizing valve 88 is positioned between the junction 86 and the inlet of a pressure building coil 92. The outlet of the pressure building coil 92 is provided with a check valve 94 and also is in fluid communication with the headspace 54 of the tank via spraybar 68.

Figure 2C:
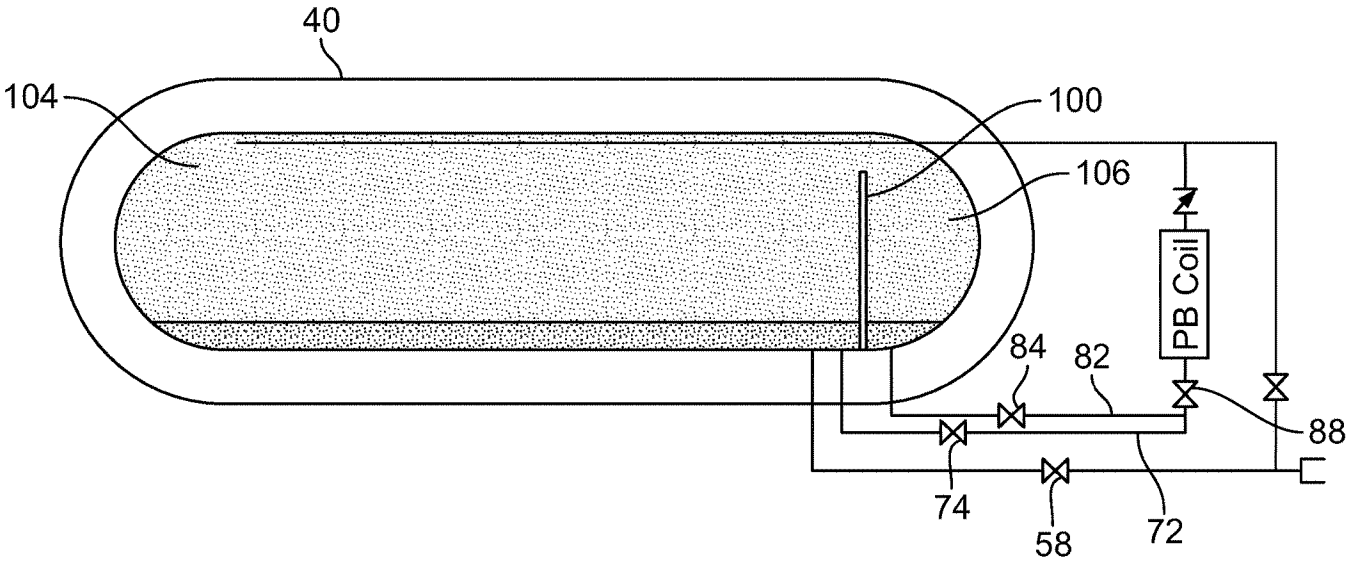
FIG. 2*c* is a schematic view of the container of FIG. 2*a* with the primary and reserve compartments nearly empty of liquid and the tank pressurized to dispense the liquid heel of the tank.

While the primary and reserve pressure building circuits share a pressure building coil 92 in FIGS. 2*a*-2*c*, they may instead be provided with separate dedicated pressuring building coils. In addition, while a pressure builder coil is illustrated, other types of vaporizers known in the art may be used instead.

Figure 3:
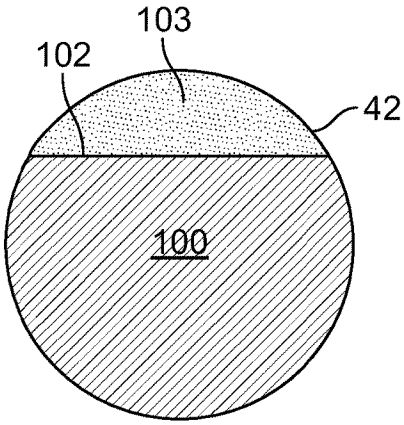
FIG. 3 is a cross sectional view of the inner vessel and partition of FIGS. 2*a*-2*c* taken along line 3-3 of FIG. 2*a*.

The interior of the tank 40 is provided with a partition 100. As illustrated in FIG. 3, the partition 100 is secured to the interior surface of the inner vessel 42 and a top edge 102 of the partition is spaced from the top of the tank so that a headspace communication passage 103 is formed. As a result, the interior of the tank 40 is divided into a primary chamber 104 (to the left of the partition 100 in FIG. 2*a*) and a reserve chamber 106 (to the right of the partition 100 in FIG. 2*a*). While liquid sides of the primary and reserve chambers are isolated from one another, the headspaces of the chambers are in fluid communication with one another due to the partition extending only part way up within the tank interior. As a result, the headspaces of the primary and reserve chambers form a common headspace and the partition 100 is not a pressure barrier and does not create an additional pressure vessel.

In place of the space provided between the top edge of the partition and the top of the tank (103 in FIG. 3), the partition could extend all of the way to the top of the tank and feature one or more openings positioned in the headspace of the tank so as to form the headspace communication passage. Furthermore, the headspace communication passage may feature any construction that permits the headspaces of the primary and reserve chambers 104 and 106 to be in fluid communication with one another.

The inlet to the primary pressure building circuit 70 is in liquid communication with the bottom of the primary chamber 104 of the tank via a primary cryogenic liquid passage, while the inlet to the reserve pressure building circuit 80 is in liquid communication with the bottom of the reserve chamber 106 of the tank via a reserve cryogenic liquid passage.

In operation, the tank 40 is initially filled to maximum capacity with cryogenic liquid 52, as illustrated in FIG. 2*a*. All of the illustrated valves are initially closed. To dispense the liquid, the connector 62 is connected to a use or storage device. The vent valve 66 may be opened to equalize the pressure between a tank of the use or storage device and the tank 40, and is then closed.

It should be noted that the tank 40 may also be refilled when the connector 62 is connected to a source of pressurized liquid and valve 66 is opened (with the remaining valves closed). The liquid entering the tank 40 through the spraybar 68 collapses the vapor pressure in the headspace 54 to permit the liquid to enter the tank.

The primary pressure building valve 74 and the equalizing valve 88 are then opened. Due to the pressure at the bottom of the tank, which results from the vapor pressure in the headspace 54 in combination with the liquid head in the primary chamber 104 of the tank, liquid cryogen travels through the primary pressure building line 72 to the pressure building coil 92 where it is vaporized. The resulting vapor travels through the check valve 94 and into the headspace 54 through the spraybar 68 so that the tank is pressurized.

When the tank reaches the desired pressure, the dispensing valve 58 is opened and liquid cryogen travels from the bottom of the primary chamber 104 of the tank through line 56, connector 62 and into the use or storage device. The liquid level of the primary chamber 104 of the tank will drop due to the withdrawal of liquid from the tank.

With reference to FIG. 2*b*, as liquid is withdrawn from the primary chamber 104 of the tank and the level nears empty, there will be insufficient pressure to force the liquid from the primary chamber to the pressure building coil 92.

At this point, the dispensing valve 58 and the primary pressure building valve 74 are closed and the reserve pressure building valve 84 of the reserve pressure building supply circuit is opened. The equalizing valve 88 remains open. Due to the liquid head in the reserve chamber 106, and what pressure is left in the headspace 54 of the tank, liquid from the bottom of the reserve chamber 106 of the tank is driven through the reserve pressure building line 82 to the pressure building coil 92, vaporized, and directed to the headspace 54 of the tank via spray bar 68 so as to build pressure therein.

Once the tank 40 has reached a sufficient pressure to dispense, the primary and reserve compartments 104 and 106 of the tank are equalized by closing the equalizing valve 88 and opening the primary pressure building valve 74 (the reserve pressure building valve 84 remains open). As a result, as illustrated in FIG. 2*c*, the liquid levels within the primary and reserve chambers 104 and 106 of the tank equalize as liquid flows through lines 72 and 82. As a result, the lines 72 and 82 and valves 74 and 84 form an equalizing circuit.

In an alternative embodiment, the equalizing circuit may be formed as a separate line running between the bottoms of the primary and reserve chambers with a valve positioned therein. In such an embodiment, the equalizing valve 88 of FIGS. 2*a*-2*c* could be omitted.

The dispensing valve 58 is then opened (equalizing valve 88 remains closed), and liquid dispensing resumes from the primary chamber 104. As liquid is dispensed from the primary chamber 104, and the liquid level therein drops, liquid from the reserve chamber 106 flows through lines 82 and 72 into the primary chamber 104 and is dispensed. As a result, both the primary and reserve chambers 104 and 106 of the tank 40 are either emptied or nearly emptied of liquid.

The valves of FIGS. 2*a*-2*c* could be manipulated manually by a user to perform the above process. The user would need to monitor pressure gauges positioned within the bottoms of the primary and reserve chambers 104 and 106 to determine when pressures are sufficient for dispensing.

Alternatively, the system and process of FIGS. 2*a*-2*c* could be automated by providing pressure sensors in the bottoms of the primary and reserve chambers 104 and 106 with a programmable controller connected to the pressure sensors. In such an embodiment, the valves of FIGS. 2*a*-2*c* would be automated and actuated by the controller in response to the pressure sensed by the pressure sensors. Alternative suitable automatic control systems known in the art could be implemented as well.

Locating the reserve chamber 106 at the end of the tank, as illustrated in FIGS. 2*a*-2*c*, is efficient and economical in that it facilitates running piping and gauges to the reserve chamber (i.e. through the end wall or dome of the tank). Nevertheless, the reserve chamber could be positioned anywhere within the interior of the tank so long as a column of liquid is provided.

The system of FIGS. 2*a*-2*c*, or other embodiments of the system, could use the reserve chamber to supplement the dispensing while dispensing from the primary chamber. More specifically, the reserve pressure building valve 84 of FIG. 2*a* could be opened while the primary pressure building valve 74 and the equalizing valve 88 are open, and before the liquid level reaches the level of FIG. 2*b*.

In summary, adding a partition inside the inner vessel allows the container to maintain a sufficient column of liquid in the reserve chamber, providing the differential pressure to drive liquid through a pressure building coil or other vaporizer at low liquid levels in the primary chamber of the container.

This solution could be applied to any horizontal cryogenic container where pressure building capabilities at low liquid levels are required and the container needs to be emptied completely.

While the preferred embodiments of the disclosure have been shown and described, it will be apparent to those skilled in the art that changes and modifications may be made therein without departing from the spirit of the disclosure, the scope of which is defined by the following claims.

What is claimed is:

1. A system for dispensing cryogenic liquid comprising;

a. a container defining an interior;

b. a partition dividing the interior into a primary chamber and a reserve chamber, each of said primary and reserve chambers configured to contain a cryogenic liquid with a headspace above the cryogenic liquid, where the cryogenic liquid within the primary chamber is separated from the cryogenic liquid in the reserve chamber, said partition also configured to provide a headspace communication passage so that the headspace of the primary chamber is in fluid communication with the headspace of the reserve chamber;

c. at least one vaporizer;

d. a primary pressure building circuit having a primary pressure building circuit inlet selectively in liquid communication with a bottom portion of the primary chamber and the at least one vaporizer having a vaporizer outlet in fluid communication with the headspaces of the primary and reserve chambers of the tank, said primary pressure building circuit configured to selectively vaporize liquid from the primary chamber to provide a primary vapor stream that is directed to the headspaces of the primary and reserve chambers;

e. a reserve pressure building circuit having a reserve pressure building circuit inlet selectively in liquid communication with a bottom portion of the reserve chamber and the at least one vaporizer having a vaporizer outlet in fluid communication with the headspaces of the primary and reserve chambers of the tank, said reserve pressure building circuit configured to selectively vaporize liquid from the reserve chamber to provide a reserve vapor stream that is directed to the headspaces of the primary and reserve chambers;

f. an equalizing circuit selectively in liquid communication with the primary and reserve chambers;

g. a dispensing line extending from the bottom of the primary chamber and having a dispensing line distal end including a nozzle or a connector, said dispensing line independent of the primary and reserve pressure building circuits and selectively in liquid communication with the bottom of the primary chamber, said dispensing line being configured so that at least a portion of liquid from the primary chamber that flows through the dispensing line does not selectively flow through the inlet of the primary pressure building circuit;

h. said primary chamber configured so that a level of cryogenic liquid within the primary chamber remains consistent throughout the primary chamber regardless of the level of cryogenic liquid as cryogenic liquid is withdrawn through the liquid dispensing line.

2. The system of claim 1 wherein the tank is a horizontal tank.

3. The system of claim 1 wherein the at least one vaporizer includes a shared vaporizer with the vaporizer outlet being a shared vaporizer outlet and wherein the primary pressure building circuit includes a primary pressure building line having a primary pressure building valve, said primary pressure building line extending from the bottom of the primary chamber, the reserve pressure building circuit includes a reserve pressure building line having a reserve pressure building valve, said reserve pressure building line extending from the bottom of the reserve chamber and wherein the primary and reserve pressure building lines features outlets that that join at a junction, where the junction is in liquid communication with an inlet of the shared vaporizer, said primary and reserve pressure building valves directing liquid solely from the primary chamber to the shared vaporizer when in a first configuration and liquid solely from the reserve chamber to the shared vaporizer when in a second configuration.

4. The system of claim 3 wherein the shared vaporizer is a pressure building coil.

5. The system of claim 3 further comprising an equalizing valve positioned between the junction and the inlet of the vaporizer so that the primary and reserve pressure building lines and the primary and reserve pressure building valves form the equalizing circuit when the primary and reserve pressure building valves are open and the equalizing valve is closed.

6. The system of claim 1 wherein the partition includes a top edge that is spaced from a top of the interior of the container so that the headspace communication passage is defined therebetween.

7. The system of claim 1 wherein the reserve chamber is positioned adjacent to an end wall of the container.

8. The system of claim 3 wherein the primary pressure building valve is separate and distinct from the reserve pressure building valve.

9. The system of claim 3 wherein the primary and reserve pressure building valves are automated and further comprising:

i. a primary pressure sensor configured to determine the pressure in the bottom portion of the primary chamber;

j. a reserve pressure sensor configured to determine the pressure in the bottom portion of the reserve chamber;

k. a controller in communication with the primary and reserve pressure sensors and the primary and reserve pressure building valves whereby the primary and reserve valves are actuated by the controller in response to the pressures sensed by the primary and reserve pressure sensors.

10. The system of claim 3 wherein the primary and reserve pressure building valves are automated and further comprising:

i. a primary pressure sensor configured to determine the pressure in the bottom portion of the primary chamber;

j. a reserve pressure sensor configured to determine the pressure in the bottom portion of the reserve chamber;

k. a controller in communication with the primary and reserve pressure sensors and the primary and reserve pressure building valves whereby the primary and reserve valves are actuated by the controller so as to be moved between the first and second configurations in response to the pressures sensed by the primary and reserve pressure sensors.

11. The system of claim 1 wherein the dispensing line is separate and distinct from the inlet of the primary pressure building circuit.

12. A system for dispensing cryogenic liquid comprising;

a. a container defining an interior;

b. a partition dividing the interior into a primary chamber and a reserve chamber, each of said primary and reserve chambers configured to contain a cryogenic liquid with a headspace above the cryogenic liquid, where the cryogenic liquid within the primary chamber is separated from the cryogenic liquid in the reserve chamber, said partition also configured to provide a headspace communication passage so that the headspace of the primary chamber is in fluid communication with the headspace of the reserve chamber;

c. at least one vaporizer;

d. a primary pressure building circuit having the at least one vaporizer including a vaporizer inlet selectively in liquid communication with a bottom portion of the primary chamber via a primary pressure building valve and a vaporizer outlet in fluid communication with the headspaces of the primary and reserve chambers of the tank, said primary pressure building circuit configured to selectively vaporize liquid from the primary chamber to provide a primary vapor stream that is directed to the headspaces of the primary and reserve chambers;

e. a reserve pressure building circuit having the at least one vaporizer including a vaporizer inlet selectively in liquid communication with a bottom portion of the reserve chamber via a reserve pressure building valve and a vaporizer outlet in fluid communication with the headspaces of the primary and reserve chambers of the tank, said reserve pressure building circuit configured to selectively vaporize liquid from the reserve chamber to provide a reserve vapor stream that is directed to the headspaces of the primary and reserve chambers;

f. an equalizing circuit selectively in liquid communication with the primary and reserve chambers, said equalizing circuit including an equalizing valve;

g. a dispensing line extending from the bottom of the primary chamber and having a dispensing line distal end including a nozzle or a connector, said dispensing line independent of the primary and reserve pressure building circuits and selectively in liquid communication with the bottom of the primary chamber, said dispensing line having a dispensing valve and being configured so that at least a portion of liquid from the primary chamber that flows through the dispensing line does not selectively flow through the inlet of the primary pressure building circuit;

h. said primary chamber configured so that a level of cryogenic liquid within the primary chamber remains consistent throughout the primary chamber regardless of the level of cryogenic liquid as cryogenic liquid is withdrawn through the liquid dispensing line;

i. a primary pressure sensor positioned in a bottom of the primary chamber;

j. a reserve pressure sensor positioned in a bottom of the reserve chamber;

k. a controller in communication with the primary and reserve pressure sensors, the primary and reserve pressure building valves and the equalizing valve whereby the primary and reserve valves are actuated by the controller in response to the pressures sensed by the primary and reserve pressure sensors, said controller configured to:

i) open the primary pressure building valve when the container has reached a predetermined fill level;

ii) open the dispensing valve when a pressure within the container reaches a predetermined pressure;

iii) close the dispensing valve and the primary pressure building valve and open the reserve pressure building valve when a liquid level within the primary chamber reaches a predetermined minimal level;

iv) configure the equalizing valve, the primary pressure building valve and the reserve pressure building valve when a pressure within the container reaches a sufficient dispensing pressure so that liquid levels within the primary and reserve chambers equalize;

v) open the dispensing valve when liquid levels within the primary and reserve chambers equalize so that cryogenic liquid is dispensed from the primary and reserve chambers.

13. The system of claim 12 wherein the at least one vaporizer includes a shared vaporizer with a shared vaporizer outlet and wherein the primary pressure building circuit includes a primary pressure building line having a primary pressure building valve, said primary pressure building line extending from the bottom of the primary chamber, the reserve pressure building circuit includes a reserve pressure building line having a reserve pressure building valve, said reserve pressure building line extending from the bottom of the reserve chamber and wherein the primary and reserve pressure building lines features outlets that that join at a junction, where the junction is in liquid communication with an inlet of the shared vaporizer, said primary and reserve pressure building valves directing liquid solely from the primary chamber to the shared vaporizer when in a first configuration and liquid solely from the reserve chamber to the shared vaporizer when in a second configuration and wherein the equalizing valve is positioned between the junction and the inlet of the vaporizer so that the primary and reserve pressure building lines and the primary and reserve pressure building valves form the equalizing circuit when the primary and reserve pressure building valves are open and the equalizing valve is closed.

14. The system of claim 12 wherein the equalizing circuit includes an equalizing line running between the bottoms of the primary and reserve chambers with the equalizing valve positioned within the equalizing line.

* * * * *